US006631574B2

(12) United States Patent
Okyere

(10) Patent No.: US 6,631,574 B2
(45) Date of Patent: Oct. 14, 2003

(54) TUBULAR ROLL CORE WITH DISPLAY

(76) Inventor: Robert Okyere, 5913 Quantrell Ave., Alexandria, VA (US) 22312

( * ) Notice: Subject to any disclaimer, the term of this patent is extended or adjusted under 35 U.S.C. 154(b) by 42 days.

(21) Appl. No.: 09/977,359

(22) Filed: Oct. 16, 2001

(65) Prior Publication Data

US 2002/0166270 A1 Nov. 14, 2002

Related U.S. Application Data

(60) Provisional application No. 60/289,808, filed on May 10, 2001.

(51) Int. Cl.[7] ..... G09F 3/00
(52) U.S. Cl. ..... 40/309; 242/600; 242/912
(58) Field of Search ..... 40/309; 242/600, 242/912

(56) References Cited

U.S. PATENT DOCUMENTS

| | | | | | |
|---|---|---|---|---|---|
| 564,418 | A | | 7/1896 | Yaggy | |
| 839,439 | A | * | 12/1906 | Underdown | 242/160.4 |
| 1,187,594 | A | * | 6/1916 | Zumvorde | 242/160.1 |
| 1,467,937 | A | | 9/1923 | Jarvis | |
| 1,827,513 | A | * | 10/1931 | Geier | 206/733 |
| 2,105,367 | A | | 1/1938 | Parsons | |
| 3,347,480 | A | | 10/1967 | Abramoff | |
| 3,467,456 | A | | 9/1969 | Chmela | |
| 3,813,801 | A | | 6/1974 | Vander Schaaf | |
| 3,859,154 | A | | 1/1975 | Monia | |
| 3,986,606 | A | | 10/1976 | Davis | |
| 4,006,275 | A | | 2/1977 | Monia | |
| 4,235,341 | A | * | 11/1980 | Martin et al. | 229/202 |
| 5,010,667 | A | * | 4/1991 | Hassinger | 40/309 |
| 5,381,984 | A | | 1/1995 | Hindsgual | |
| 5,913,765 | A | | 6/1999 | Burgess et al. | |
| 6,089,483 | A | * | 7/2000 | St-Laurent | 242/160.4 |
| 6,402,086 | B1 | * | 6/2002 | Myers, Jr. | 242/600 |

* cited by examiner

*Primary Examiner*—Andrea Chop
(74) *Attorney, Agent, or Firm*—Richard C. Litman

(57) ABSTRACT

The tubular core of a rolled product (e.g., toilet tissue, foil, plastic wrap, paper towels, etc.) includes an advertising or other display thereon, visible to consumers when the product has been removed from the roll. The display may be applied directly to the core, or to a thin, flexible secondary sheet applied in turn to the core. The core tube with its message or secondary sheet and rolled product may be assembled and cut to length during manufacture. Alternatively, the secondary sheet may have a width somewhat wider than the length of the tube, so the ends of the sheet wrap around the ends of the tube and are visible about the ends of the tube when a rolled product is installed upon the tube. The present invention may be used for advertising, safety, public service, chance means (lottery, etc.) or other messages as desired.

12 Claims, 5 Drawing Sheets

TUBULAR ROLL CORE WITH DISPLAY

CROSS-REFERENCE TO RELATED APPLICATION

This application claims the benefit of U.S. Provisional Patent Application Serial No. 60/289,808, filed May 10, 2001.

BACKGROUND OF THE INVENTION

1. Field of the Invention

The present invention relates generally to advertising and display means, and more specifically to the provision of such display means upon the tubular cores of rolled products, such as toilet tissue, plastic and aluminum foil, paper towels, etc. The present invention provides text and/or graphic messages and displays upon or within the cores of such rolled products, to provide utility for a previously useless article once the rolled material was depleted.

2. Description of the Related Art

Rolled products of various types are found nearly universally in homes, offices and other businesses, etc. The provision of toilet tissue, paper towels, aluminum and plastic wrap, etc, on an inexpensive cylindrical core of paper or other suitable product, has been found to be an economical means of manufacturing and supplying such goods to the consumer.

Heretofore, the tubular cores of such rolled goods were devoid of any information or display thereon, and were considered to be throwaway, waste articles, in much the same manner as wrapping material, cans and other containers, etc. The present invention makes use of this previously wasted area to provide advertising and other messages as desired, thereby transforming such tubular cores into useful articles. Even greater value to the consumer may be provided by providing such cores with some value, such as a discount on a like product with the return of a core from a previously used roll, or perhaps public service and/or safety messages, etc. Selective printing or wrapping of the cores with different messages may also be used as chance means for prizes, free products or discounts on products, etc.

The present invention may be accomplished by printing directly upon or within the core, or by applying a sheet of material over the core before wrapping the core with the sheet product for later dispensing. This may be easily accomplished at the time of manufacture by rolling the continuous core length with a sheet including messages, coupons, etc., before rolling the product onto the core and cutting the assembly to length. Alternatively, the core may be cut to length and a display sheet wrapped about the tubular core, with the sheet overlapping the ends of the core so it is visible even when the sheet product is rolled about the core. By providing an attention getting appearance (e.g., paper money, etc.) along the edge of such a roll core where it is visible even when the rolled product is on the core, persons are attracted to the specific product in order to determine the underlying message or financial advantage of the core when the rolled product on the core has been used up.

A discussion of the related art of which the present inventor is aware, and its differences and distinctions from the present invention, is provided below.

U.S. Pat. No. 564,418 issued on Jul. 21, 1896 to Levi W. Yaggy, titled "Panoramic Display Device," describes a thin, box-like structure having a series of rollers therein with a scroll disposed over the rollers. The scroll is arranged to roll from one roller to a takeup roller, and passes over an idler roller to reverse its direction before being wound upon the takeup roller. This provides for the display of portions of both sides of the scroll, through windows formed in the box. Yaggy does not disclose any advertising or display means permanently printed or wrapped about the rollers themselves, or upon a disposable roll core, as provided by the present invention. Rather, the Yaggy display is on the sheet material being dispensed back and forth between the rollers, rather than on the rollers themselves, as in the present invention.

U.S. Pat. No. 1,467,937 issued on Sep. 11, 1923 to Basil E. Jarvis, titled "Advertising Device," describes a display sheet retractably disposed upon a roller, with the free end of the sheet being secured to the distal end of a folding latticework type grate or the like. When the grate is extended, the advertising sheet is unrolled from its roller for display. As in the Yaggy device discussed immediately above, Jarvis provides the display upon a sheet of material which is retractably extended from a roller, rather than on a disposable roller itself.

U.S. Pat. No. 2,105,367 issued on Jan. 11, 1938 to Philip D. Parsons, titled "Wrapper Or Label For Toilet Packages," describes a wrapper for a rolled article (e.g., toilet tissue), with the wrapper being formed of paper with its grain structure oriented to permit ease of tearing the wrapper open in a direction parallel to the rotary axis of the roll. Advertising or display means is illustrated on the wrapper in the drawing Figures, but Parsons does not disclose any information about the tubular roll core of the rolled article, which core and display means thereon forms the present invention.

U.S. Pat. No. 3,347,480 issued on Oct. 17, 1967 to Jacques Abramoff, titled "Paper Dispenser," describes a dispenser for rolled articles with a secondary roller behind the main roll, over which the sheet material is passed. Abramoff states that this results in more even tearing of the sheet. No disclosure is made of the appearance of the roll core upon which the rolled material is wound. Abramoff only discloses that the secondary roller has a roughened surface for causing it to rotate during dispensing of the sheet material, but this secondary roller does not contain the sheet material, but only guides it during dispensing.

U.S. Pat. No. 3,467,456 issued on Sep. 16, 1969 to John F. Chmela, titled "Decorative Cover," describes a cover for fitting removably over a roll of toilet tissue installed upon a roller. While Chmela states that the cover may include decoration thereon, he does not disclose any advertising or display means, nor any appearance whatsoever, for the core of the roll within his cover.

U.S. Pat. No. 3,813,801 issued on Jun. 4, 1974 to Clair D. Vander Schaaf, titled "Advertising Or Novelty Device," describes a curved sheet of material which is removably applied to a can or similar container to provide an advertising or novelty display thereover. The Vander Schaaf cover differs considerably from the present invention, in that (a) the Vander Schaaf cover is applied by the end user, rather than during manufacture of the underlying article; (b) The Vander Schaaf cover is intended only for use on articles such as beverage cans and the like, with the thickness of the insulating means teaching away from the thin sheet of material or printed means used on roll cores according to the present invention; (c) The Vander Schaaf cover is reusable, whereas the present roll core display means is applied once during manufacture and is not reapplied to another roll core or other cylindrical article later; and (d) the Vander Schaaf cover is sufficiently rigid as to take on a natural curved set to conform to the shape of the can to which it is applied, whereas the embodiment of the present invention wherein a sheet of material is applied to the roll core utilizes a very thin and flexible sheet of material.

U.S. Pat. No. 3,859,154 issued on Jan. 7, 1975 to Victor Monia, titled "Method Of Forming Tubular Walls For Product Containers," describes the construction of toothpaste tubes from a preprinted structural wall material having alternating patterns or designs thereon. The structural wall is formed by wrapping one sheet of the material, containing both patterns or designs thereon, twice about the forming mandrel before sealing to form the tube. The outer surface of a tube formed from a sheet manufactured according to Monia may have either of two different designs displayed thereon, depending upon which design was first wound upon the mandrel, with the second design thus being the outermost one being displayed. Monia does not disclose any means for wrapping the pre-printed structural wall material of his invention about an existing tubular roll core for subsequent rolling of sheet material (toilet tissue, foil or plastic wrap, etc.) thereover, as provided by the present invention. In fact, Monia teaches away from the present invention in that his sheets must have sufficient strength to form the structure of the product contained therein, whereas the present invention need only comprise a very thin and flexible sheet of material applied over an existing tubular roll core, or may be achieved by printing the information or pattern on and/or within the roll core.

U.S. Pat. No. 3,986,606 issued on Oct. 19, 1976 to William F. Davis, titled "Dual Purpose Container Label," describes a cylindrical container having a metallic foil label spirally wrapped therearound. The label is removed and the inner surface, i.e., the surface without any printing or other indicia thereon, is used as a cooking surface for the contents of the can. As the foil is wrapped spirally about the can, the removal of the sheet results in any message on the sheet being broken up due to the spiral break across the sheet. Moreover, the Davis foil must be sufficiently durable to be folded to provide some rigidity as a cooking vessel, and is not a thin, flexible sheet or markings directly upon the underlying cylinder, as in the present invention.

U.S. Pat. No. 4,006,275 issued on Feb. 1, 1977 to Victor Monia, titled "Material For, And Method Of Forming, Tubular Walls For Product Containers," describes the same material and method as described in the '154 U.S. patent issued to the same inventor and described further above. The '275 U.S. patent is a division of the parent '154 U.S. patent, with claims directed to the article of manufacture, rather than the method of manufacture as in the parent '154 U.S. patent. The same distinctions noted further above between the method and apparatus of the Monia '154 U.S. patent and the present invention are seen to apply here as well.

U.S. Pat. No. 5,381,984 issued on Jan. 17, 1995 to Kim Hindsgual, titled "Tubular Body, Especially As A Core Element, And A Roll With A Core Element," describes a dispensing roll for rolled articles such as protective disposable toilet seat covers or the like. Hindsgual discloses the installation of a fragrance producing insert within the core of the roll, but no disclosure is made of any form of advertising or other display disposed upon the outer surface of the roll for viewing when the material rolled upon the core has been used, as provided by the present invention.

Finally, U.S. Pat. No. 5,913,765 issued on Jun. 22, 1999 to William H. Burgess et al., titled "System And Method For Embossing A Pattern On A Consumer Paper product, " describes such a method in accordance with the title of the patent. No tubular roll core or application of display means thereto is disclosed by Burgess et al.

None of the above inventions and patents, either singly or in combination, is seen to describe the instant invention as claimed.

SUMMARY OF THE INVENTION

The present invention comprises the application of display means (advertising, information, etc.) to the outer and/or inner surface of the tubular core of a rolled product (toilet tissue, foil and plastic wrap, paper towels, etc.). While the display is for the most part concealed during the time that at least some of the rolled sheet product remains on the roll core, the display becomes visible as the last of the rolled product is removed from the tubular core. The display may comprise advertising encouraging the user to purchase more of the product, and perhaps discounts toward such future purchases. Alternatively, the display may advertise some other related or unrelated product(s) or service(s), as desired, or may provide public service and/or safety messages.

The means used for applying the display to the outer surface of the roll core may apply different messages to different portions of an uncut roll before cutting to length, thus providing chance means for users of products incorporating the present invention The display means applied to the roll cores may be in the form of colored or monotone ink or other printing, or may be applied as a separate display sheet to an otherwise unadorned roll core before the product is rolled thereon during manufacture. When a separate sheet of material is applied to the roll core, the ends of the sheet may remain slightly longer than the core, and may be tucked into the inner roll core to wrap around the end. The visible edge of the display sheet may have an appearance of money or some other appearance to attract attention to the product.

The present display means provides advertisers and others with a means of carrying their messages which costs nothing to process or ship, as it is already a part of the manufactured product. Yet, such empty roll tubes are encountered constantly by people as rolled product is used from such a tubular roll core. By providing advertising or other message(s) of sufficient interest and value to the user, the present display means will prove to be a most effective means of spreading the message of the messenger using the present advertising or message system. The income produced for the manufacturer by the additional advertising means, will serve to lower the cost of the product and thereby benefit the consumer and encourage further purchases of the product to benefit the manufacturer as well.

Accordingly, it is a principal object of the invention to provide an improved display means for the tubular cores of rolled sheet products.

It is another object of the invention to provide an improved display means for tubular cores which may comprise text and/or graphic display means in any combination thereof, applied either directly to the outer and/or inner surface of the roll core or applied by means of a thin, flexible secondary sheet of material applied to the core.

It is a further object of the invention to provide an improved display means for tubular cores having a secondary sheet which may be longer than the length of the core tube and wrap around the ends in order to be displayed when rolled product remains upon the core.

An additional object of the invention is to provide an improved display means for tubular cores having a secondary sheet edge which provides an eye catching appearance, such as paper money or the like, for the core ends when rolled product remains upon the core.

Still another object of the invention is to provide an improved display means which may provide different displays randomly distributed among consumers to provide chance means for the acquisition of a winning roll core.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
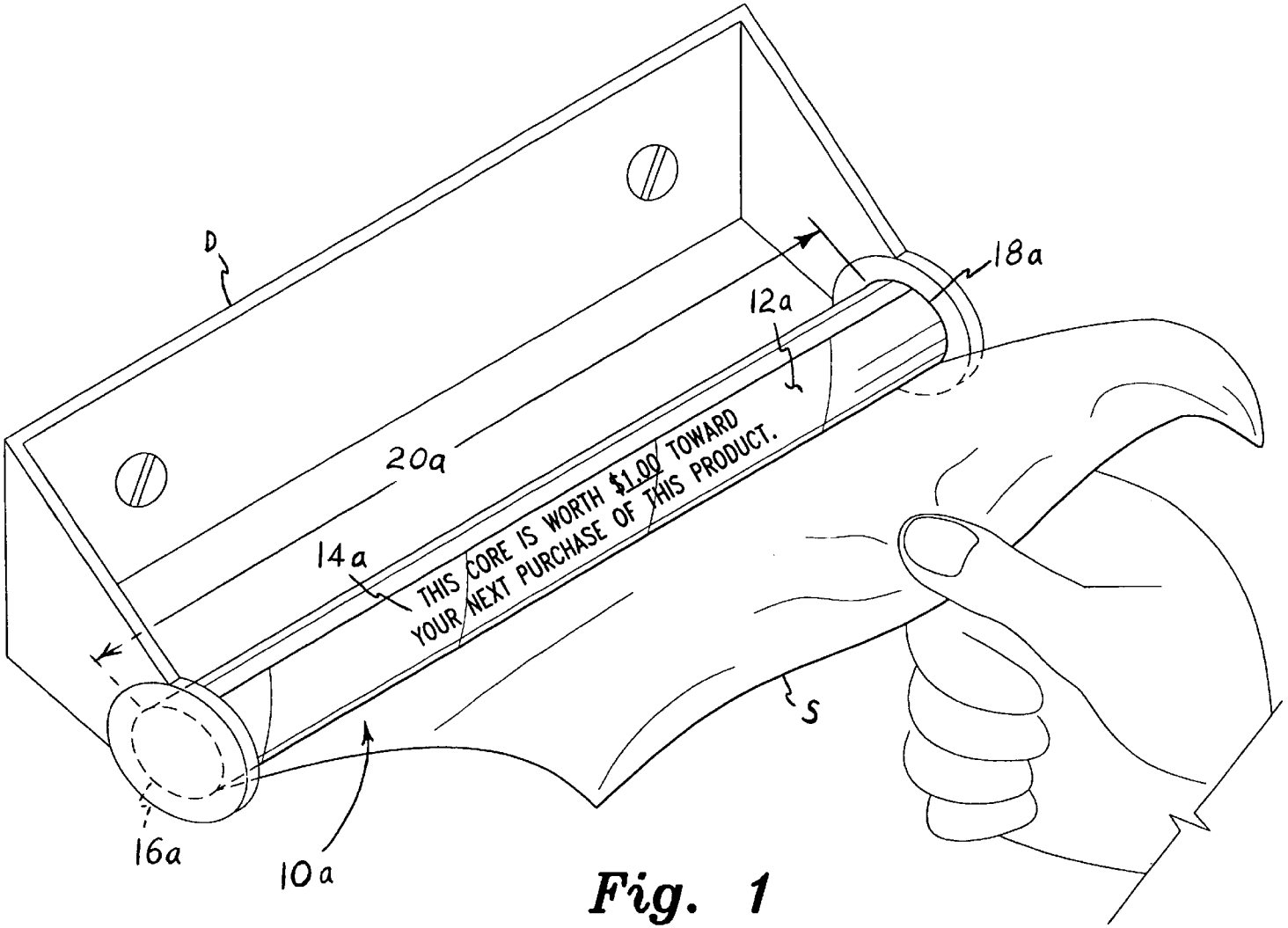
FIG. 1 is an environmental perspective view of the present invention with its display as the last sheet of a rolled product is pulled from the core.

The present invention comprises a new means of providing advertising and/or other information to consumers, by providing the information on the outer (or alternatively, the inner) surface of the tubular core of a rolled product (e.g., toilet tissue, waxed paper wrap, plastic wrap, metal foil, paper towels, etc.). Normally, this surface is concealed by the product which is wound upon the tubular core of the product roll. However, when the last sheet of material is removed from the core, the outer surface of the core is visible, along with any advertising or other display provided thereon. Such core tubes (indicated generally by the reference character 10 throughout the drawings) have a hollow, generally cylindrical configuration with an outer surface (indicated generally as 12) upon which advertising and/or another display (generally 14) may be placed, with open opposed first and second ends (generally 16 and 18, respectively) defining a length (generally 20) therebetween.

FIG. 1 illustrates the above invention, with the last sheet S of a rolled product being removed from the tubular roll core 10*a* to display a message 14*a* on the outer surface 12*a* of the tube 10*a*. Such a message 14*a* may provide a discount or other incentive to purchase more of the product, as indicated in FIG. 1, or may comprise some other type of message as desired. Such tubes 10*a* are conventionally formed of a spiral wound paper material, as shown throughout the drawings. However, the present display means is applicable to tubular cores formed of other materials and in other manners, as well. While the core 10*a* of FIG. 1 is illustrated with its first and second ends 16*a* and 18*a* being removably captured in a dispensing rack or bracket, such a dispenser D is not a required part of the present invention. It will be seen that the provision of a display upon the outer surface of a tubular roll core may be accomplished with other rolled materials conventionally dispensed from boxes, such as metal foils and plastic wrap, etc.

Figure 2:
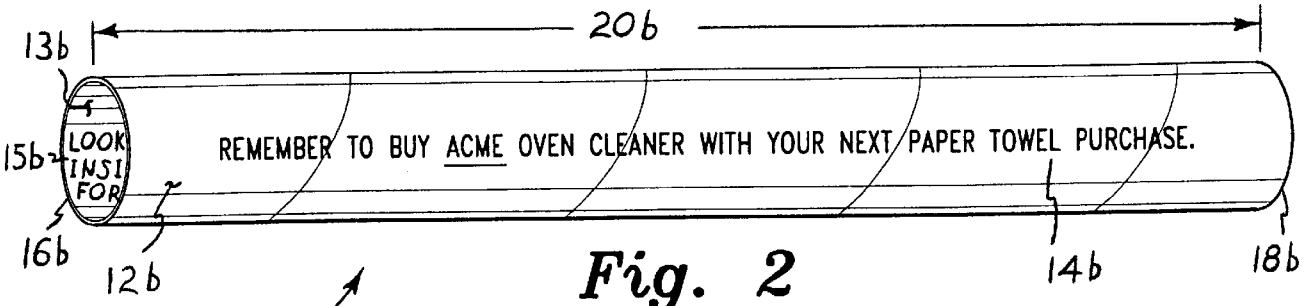
FIG. 2 is a perspective view of a second embodiment of the present invention, and exemplary display means disposed thereon and therein.

FIG. 2 provides a perspective view of another elongate roll core tube, designated as core tube 10*b*. The tube 10*b* construction is essentially the same as that of the tube 10*a*, with the tube 10*b* having a first or outer surface 12*b* with a message 14*b* provided thereon, and opposite first and second ends, respectively 16*b* and 18*b*, which define a length 20*b* therebetween for the tube 10*b*. However, rather than providing an economic incentive message, as in the message 14*a* of the tube 10*a* of FIG. 1, the message 14*b* comprises a "tie-in" message for a product which might be used with paper towels as might be provided on the roll core 10*b*.

It will be seen that message placement according to the present invention is not limited only to the first or outer surface 12*b* of the roll core 10*b*. In FIG. 2, an additional message 15*b*, e.g., "Look inside for . . . " (valuable coupons, etc.) has been placed upon the second or inner surface 13*b* of the roll core 10*b*. The use of the second or inner surface 13*b* of the roll core 10*b* (and/or any of the other embodiments described herein), effectively doubles the area available for messages, advertising, discounts, etc.

Figure 3:
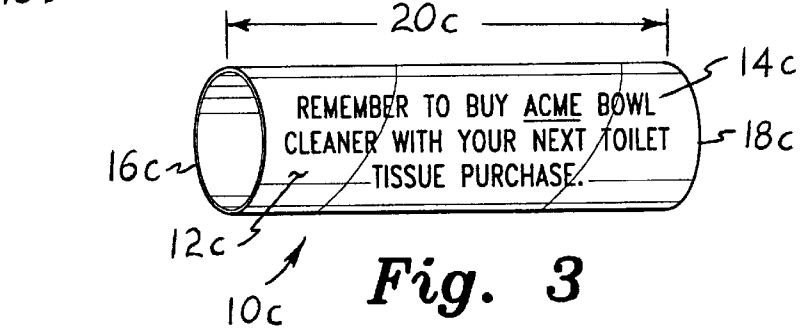
FIG. 3 is a perspective view of a third embodiment of the present invention, and exemplary display means disposed thereon.

FIG. 3 illustrates a perspective view of yet another tubular roll core 10*c*, having a shorter length 20*c* as might be provided with toilet tissue or the like. Here again, the message 14*c* may comprise a "tie-in," where the viewer is asked to purchase a product (e.g., toilet bowl cleaner) related in some manner to the use of the material just used from the roll core 10*c* (e.g., toilet tissue). An economic incentive, e.g. the return of the core for a discount on the next purchase, or upon the purchase of the related article, as indicated generally in FIG. 1, may also be provided upon the roll cores 10*b* and 10*c* respectively of FIGS. 2 and 3.

Figure 4:
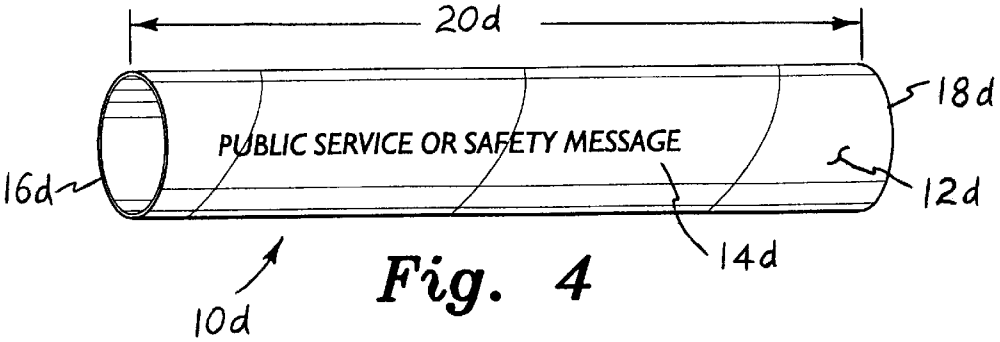
FIG. 4 is a perspective view of a fourth embodiment of the present invention, and exemplary display means disposed thereon.

FIG. 4 illustrates yet another variation upon the present invention, in which a roll core 10*d* is provided with a public service or safety message 14*d* on the outer surface 12*d* thereof. Such messages 14*d* may comprise safe driving reminders, reminders to stay in school and/or read more, etc. Such public safety messages 14*d* may result in some tax credit for companies providing the messages, thus resulting in at least a slight reduction in cost for the product which may be passed to the consumer. The lower price may result in increased sales of the product, thus benefitting consumer and the company alike. Such public service and safety messages are known in other media (e.g., milk cartons and other packaging, etc.), but the provision of such messages on the tubular core of a rolled product is novel and increases the impact of the message, just as it increases the impact of any advertising message which might be provided upon such a roll core.

To this point, it has been understood that the same message would be provided upon an entire series of tubular roll cores during manufacture of the roll product. However, different messages may be provided upon different roll cores for a given product at the time of manufacture, if so desired.

Generally, rolled products are manufactured in relatively long lengths and are cut to length after the core tubes have been formed and the product has been rolled or wound upon the core. The application of advertising and/or other messages to the roll core would thus normally be accomplished before the roll core (and product wound thereon) are cut to length. This method lends itself to the provision of different messages upon a series of such roll cores, by applying repeating identical messages upon a relatively long length of the core tube before winding the rolled product onto the elongate tube and cutting the product and tube to length. However, one or more of the messages may be different, to provide a distinctive message on one (or more) of a series of otherwise identical roll cores.

Figure 5:
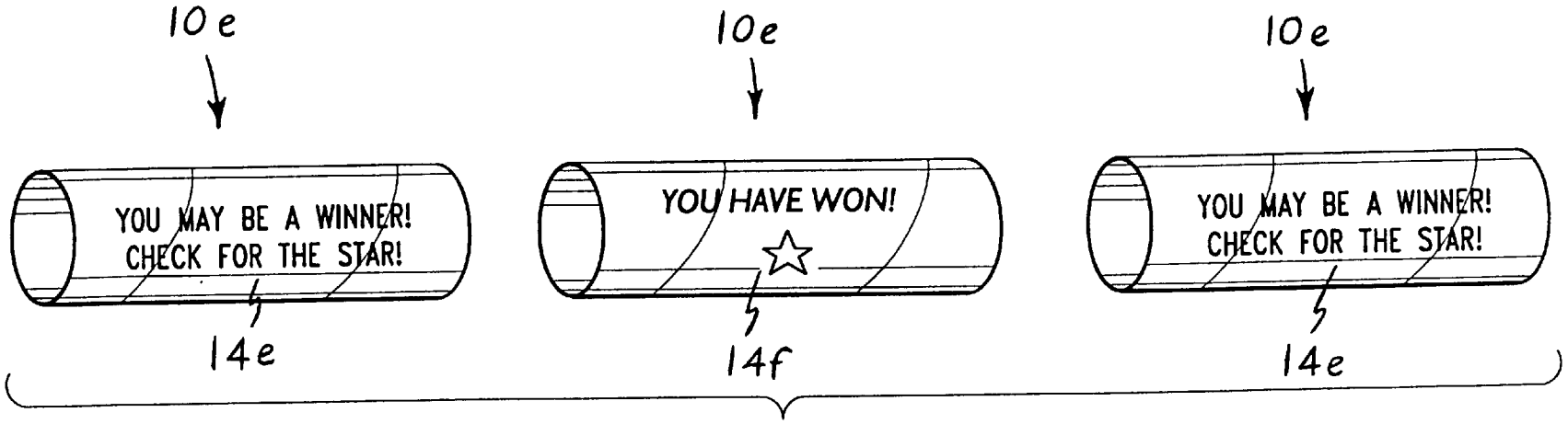
FIG. 5 is a perspective view of the provision for different messages upon different sections of a tubular roll core, for providing chance means for persons acquiring certain core tubes.

FIG. 5 illustrates such an arrangement, with two roll cores 10*e* and their identical messages 14*e* separated by a third identical roll core 10*e* carrying a different message 14*f*. This method of providing a different message to one (or more) of a series of roll cores, lends itself to use in providing random chance means for a consumer to win a prize, receive a discount or a free product, etc. Instructions may be provided on the outer packaging to check the roll core for a star or other message indicating a winner.

It will be seen that the above system provides a relatively large percentage of winning roll cores e.g., ten percent for manufacture in which the completed roll is cut into ten separate smaller rolls for consumer use. However, by providing a relatively large stamping roller for applying the message to the tubular cores, perhaps only one in ten precut cores may be provided with a winning message. If the precut core provides a total of ten cores after cutting to length, it will be seen that only one in one hundred completed cores 10*e* would carry a winning message. It will be seen that the above described percentages and odds are exemplary, and depend upon the diameters of the roll cores and the stamping roller (assuming this method is used to apply the messages), and the number of completed rolls cut from a single roll at the time of manufacture. Other means may be used (e.g., blanking the winning marking) to provide a winner only once in every several hundred or several thousand roll core segments, if so desired.

Figure 6:
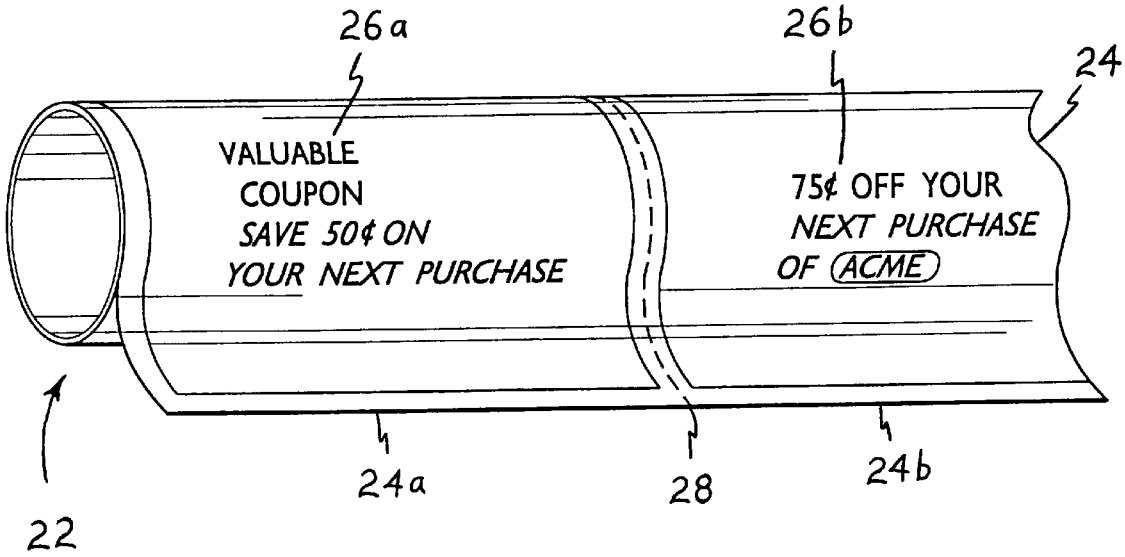
FIG. 6 is a partial perspective view of a tubular roll core, showing the wrapping of the core with a series of different coupons.

To this point, the means used to apply the advertising and/or other messages to the roll cores has been indicated as a conventional imprinting process. However, other means may be used to apply a message(s) to the roll cores, if so desired, as indicated in FIG. 6 of the drawings. Rather than imprinting the message(s) on the roll(s) before winding the sheet product on the roll, the roll 22 of FIG. 6 is covered with a thin, flexible secondary sheet 24 which includes information (generally indicated as 26, e.g., graphics, text, etc.) thereon.

It will be seen that direct imprinting of information upon a roll, as shown in FIGS. 1 through 5 of the drawings, may include graphics, color, etc., if so desired. However, the provision of such an information display 26 (or 26*a*, 26*b*, etc.) on a secondary sheet 24 which is in turn applied to the roll core 22, provides greater versatility in presenting the information provided. For example, the information 26 may comprise a full color spread of graphics and text, with such colors being difficult to reproduce attractively upon the outer surface of a plain paper roll, which is generally formed of unbleached paper having a brown color or tint. The wrapping of the roll core 22 with a secondary sheet 24 allows the information 26 provided thereon to be in any number and combination of colors, tints, and brilliance as desired.

The use of a secondary sheet 24 provides additional advantages, in that the sheet 24 may be provided with lines of weakening 28 (perforations, etc.), dividing the sheet 24 into a series of different zones, e.g., 24*a*, 24*b*, etc. Each of these zones or segments 24*a* and 24*b* may include a different message, e.g., "Valuable Coupon, Save 50 Cents On Your Next Purchase" on a first coupon 24*a*, and a different coupon for the purchase of a different product, e.g., "75 Cents Off Your Next Purchase Of Acme" on a second coupon 24*b*. It will be seen that any practicable number of such separable coupons or other messages 24*a* and 24*b* may be provided along the length of the cut tubular core 22 during manufacture, as desired, enabling the consumer to take advantage of several different offers provided with a single roll product. Such separable coupons may also be separated along one or more lines parallel to the length of the tube, if so desired, in addition to or in lieu of diametric separation lines as shown in FIG. 6.

Another advantage to the provision of the display by means of a secondary sheet, is that the information content of the secondary sheet may be varied from sheet to sheet as desired, as in providing a special marking (star, etc.) or number on a relatively small percentage of such sheets, as is done in printing "scratch-off" cards and the like for lotteries. Thus, a single product roll with its concealed tubular core (when the product is contained thereon) out of many thousands or millions of apparently identical units, may contain a winning symbol, number, etc., by applying the single winning sheet to the roll core at the time of manufacture. Such small odds provide for the use of the present tubular roll core with display means as a means of providing for a relatively large prize or prizes, as desired. It should be noted that such "scratch-off" concealment, and indicia concealed thereunder, may be applied directly to the outer or inner surface of the roll core itself, if so desired, rather than being limited to a separate sheet.

Figure 7A:
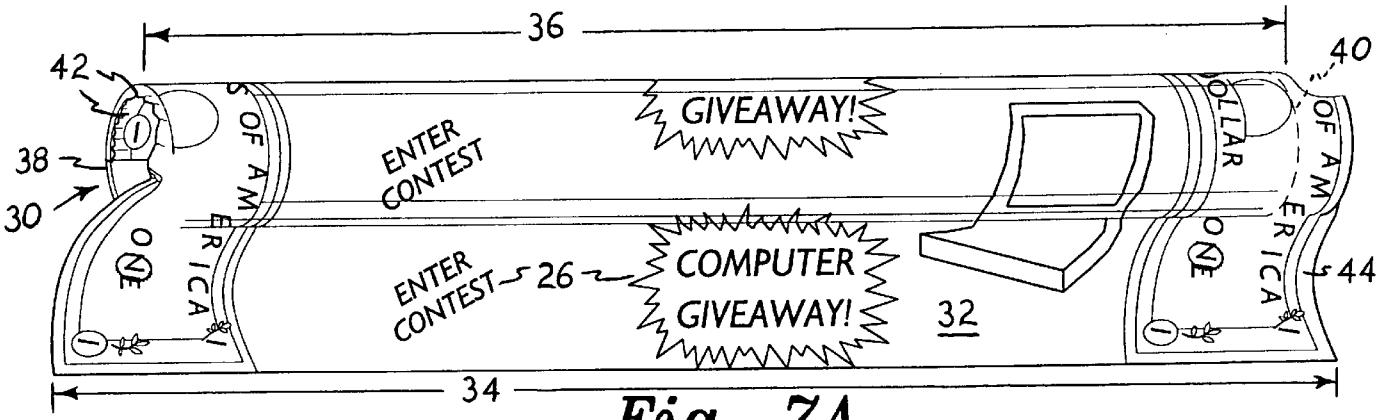
FIGS. 7A and 7B are perspective views respectively of an alternative embodiment comprising the installation of a separate display sheet upon a tubular core, and the display of the end of the core with its display sheet upon a roll containing rolled sheet product thereon.
Figure 7B:
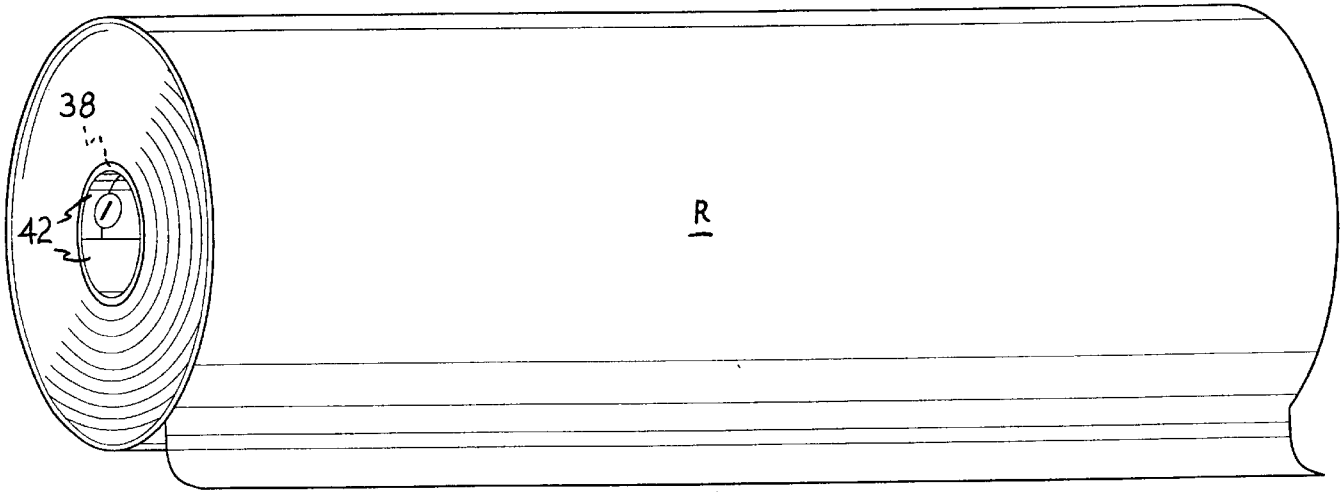

By altering the conventional order of the steps of forming a rolled product, the secondary sheet may provide additional display means as well, as shown in FIGS. 7A and 7B. By cutting the roll core 30 to length before applying the secondary sheet 32, then applying the sheet 32 and finally wrapping the rolled product R upon the core tube 30 and over the secondary sheet 32, the secondary sheet 32 may be made somewhat wider than the roll core 30 and its rolled product R (FIG. 7B) wrapped thereon. The wider edge of the secondary sheet 32 is thus visible along the circular edge or end of the tubular core, to catch the eye of the consumer even though the core 30 and secondary sheet 32 are covered with the rolled product R thereon, as shown in FIG. 7B.

FIG. 7A generally illustrates this process. In FIG. 7A, it will be seen that the secondary sheet 32 has a width 34 somewhat wider than the length 36 of the tubular roll core 30. This extended width 34 provides sufficient material to wrap around the first and second ends 38 and 40 of the tube 30, to be tucked or folded into the hollow interior of the tube 30. Thus, any decorative display means provided along the first and second edge borders or portions 42 and 44 of the secondary sheet 32, will be visible along the exposed edges or ends 38 and 40 of the tube 30, even though a rolled product R has been wrapped onto the tube 30 and over the secondary sheet 32. The visibility of the first edge portion 42 within the completed roll of material R is clearly apparent in FIG. 7B of the drawings.

In order to catch the eye of a potential purchaser or consumer of the rolled product R, it is preferable to provide a particularly eye catching and attention attracting display for the first and second edge or border portions 42 and 44 of the secondary sheet 32, as a small part of each of these edge or border portions 42 and 44 will be the only part of the secondary sheet 32 which will be visible to consumers before the rolled sheet product R wrapped about the tube 30 and secondary sheet 32 is nearly completely removed from the assembly. An example of such an eye catching display is provided in FIGS. 7A and 7B, where the first and second edge portions 42 and 44 have an appearance representative of paper money, e.g., one dollar bills. (Other patterns or displays may be provided as desired, e.g., representations of lottery tickets, stock certificates, large denomination checks, etc., as desired.) The glimpse provided of an apparent paper money bill tucked into the end of the rolled sheet product assembly, as shown in FIG. 7B of the drawings, serves to catch the eye and attract the attention of the consumer or potential purchaser of the product, even before the rolled sheet product R has been removed from the underlying tube 30 and its secondary sheet wrap 32.

In summary, the present tubular roll core with its display means provides a novel and heretofore untouched and unanticipated means of providing additional messages, displays, and advertising and the like to purchasers and consumers of rolled sheet products (paper, plastic and metal foil, etc). The provision of advertising opens up further revenue potential for manufacturers of such products, as well as for related or unrelated products and services (computers, software, etc.) which may purchase such advertising opportunities from the manufacturers of such rolled sheet goods. Manufacturers may enjoy certain economic benefits even without advertising, by providing public service and/or safety messages upon the tubular cores. Any tax breaks or advantages provided by such public service messages serve to reduce the cost of doing business for the manufacturer, who may then pass the cost reductions on to the consumer in the form of lower prices to encourage the purchase of the product.

The present invention also provides various means for encouraging purchasers and consumers to purchase and use the rolled product provided on the tubular roll core to which the display or advertising has been applied. One such means is by offering a discount or other incentive toward the purchase of a like product, or perhaps a related product. Another means for encouraging consumers and purchasers is through chance means which may be randomly provided on a certain percentage of the roll cores of the rolled sheet products. Any winning (or losing) roll cores are concealed by the rolled sheet product or goods which have been wrapped upon the tubular core during manufacture, thus providing a truly randomized means of distributing winning (or losing) chances to purchasers and consumers. Yet another means for encouraging the purchase and use of rolled goods using the present invention, is by providing a secondary sheet having a width greater than the length of the underlying roll core, and wrapping the edges of the secondary sheet about the ends of the roll core where they are visible even when the core is covered with a rolled product which has been wrapped thereon. By providing an eye catching display, such as money or other attention getting display, a consumer will be attracted to the display and thus to the rolled sheet product which has been wrapped upon the tubular core and over the secondary sheet. Such secondary sheets further broaden the display which may be provided, in terms of more colors and brightness, etc., over that which might be provided by imprinting directly upon the roll core.

Accordingly, the present invention in any of its embodiments will be seen to provide a new means for reaching consumers and purchasers of rolled goods. The advantages provided by the present invention are at little increased cost to the manufacturer, as no additional marketing, delivery, and handling costs are associated with the present invention, unlike those costs associated with other forms of advertising. The advantages and economic benefits of the present invention to manufacturers of rolled products, will be much appreciated by those manufacturers.

It is to be understood that the present invention is not limited to the embodiments described above, but encompasses any and all embodiments within the scope of the following claims.

I claim:

1. A roll core with display, comprising:

a tube for dispensing a rolled sheet product therefrom;

said tube comprising a hollow cylinder having at least an outer surface and an inner surface, a completely open first end, and a completely open second end opposite said first end defining a length therebetween; and a display comprising a thin, flexible secondary sheet applied to said outer surface of said tube, wherein:

said secondary sheet has a width wider than said length of said tube, a first edge portion, and a second edge portion opposite said first edge portion, the first edge portion and the second edge portion of said secondary sheet wrapping respectively around the first end and the second end of said tube and folded therein, and the first edge portion and the second edge portion of said secondary sheet being visible respectively along the first end and the second end of said tube when said secondary sheet is disposed upon said tube.

2. The roll core with display according to claim 1, wherein the first edge portion and the second edge portion of said secondary sheet each include eye catching display indicia disposed thereon for attracting attention of a consumer of any rolled sheet product disposed upon said tube.

3. The roll core with display according to claim 1, wherein said tube is formed of spiral wound paper.

4. A rolled product including a roll core with display, comprising:

a tube for dispensing a rolled sheet product therefrom, a flexible, rolled sheet product disposed upon said tube, for dispensing therefrom as desired;

said tube comprising a hollow cylinder having at least an outer surface and an inner surface, a completely open first end, and a completely open second end opposite said first end defining a length therebetween; and display means for viewing when said rolled sheet product has been removed from said tube, said display means comprising a thin, flexible secondary sheet applied to at least one said surface of said tube, wherein:

said secondary sheet has a width wider than said length of said tube, a first edge portion, and a second edge portion opposite said first edge portion, the first edge portion and the second edge portion of said secondary sheet wrapping respectively around the first end and the second end of said tube and folded therein; and the first edge portion and the second edge portion of said secondary sheet are visible respectively along the first end and the second end of said tube when said rolled sheet product is disposed upon said tube.

5. The rolled product and roll core with display according to claim 4, wherein the first edge portion and the second edge portion of said secondary sheet each include eye catching display indicia disposed thereon for attracting attention of a consumer of said rolled sheet product.

6. The rolled product and roll core with display according to claim 4, wherein said tube is formed of spiral wound paper.

7. The rolled product and roll core with display according to claim 4, wherein said rolled sheet product is selected from the group consisting of toilet tissue, paper towels, plastic wrap, waxed paper, and metal foil.

8. A method of providing a display on a roll core for a rolled sheet product, comprising the following steps:

providing a tube for dispensing a rolled sheet product therefrom, the tube comprising a hollow cylinder having at least an outer surface and an inner surface, a completely open first end, a completely open second end opposite said first end, and a length defined by the first and second end;

disposing a display upon at least a portion of at least one surface of the tube so that the display may be viewed when the rolled sheet product has been removed from the tube;

providing a thin, flexible secondary sheet;

disposing display indicia upon the secondary sheet;

applying the secondary sheet to the at least one surface of the tube;

forming the secondary sheet to have a width wider than the length of the tube, with a first edge portion and a second edge portion opposite the first edge portion;

wrapping the first edge portion and the second edge portion of the secondary sheet respectively around the first end and the second end of the tube;

folding the first edge portion and the second edge portion of the secondary sheet respectively within the first end and the second end of the tube; and providing a flexible, rolled sheet product disposed upon the tube, for dispensing therefrom as desired, so that the first edge portion and second edge portion of the secondary sheet respectively are exposed for viewing along the first end and the second end of the tube, beneath the rolled sheet product disposed upon the tube.

9. The method of providing a display according to claim 8, further including the step of providing a flexible, rolled sheet product disposed upon the tube, for dispensing therefrom as desired.

10. The method of providing a display according to claim 8, wherein the step of disposing a display further includes applying display indicia directly to the at least one surface of the tube.

11. The method of providing a display according to claim 8, further including the step of providing eye catching display indicia disposed upon the first edge portion and the second edge portion of the secondary sheet, whereby a consumer's attention is attracted by the eye catching display indicia on the secondary sheet.

12. The method of providing a display according to claim 8, further including the step of forming the tube of spiral wound paper.

* * * * *